US010639808B2

(12) United States Patent
Ren

(10) Patent No.: US 10,639,808 B2
(45) Date of Patent: May 5, 2020

(54) ELASTIC FASTENER FOR RAZOR

(71) Applicant: Xiangrong Ren, Wenzhou (CN)

(72) Inventor: Xiangrong Ren, Wenzhou (CN)

( * ) Notice: Subject to any disclaimer, the term of this patent is extended or adjusted under 35 U.S.C. 154(b) by 0 days.

(21) Appl. No.: 16/316,546

(22) PCT Filed: Sep. 19, 2016

(86) PCT No.: PCT/CN2016/099288
§ 371 (c)(1),
(2) Date: Jan. 9, 2019

(87) PCT Pub. No.: WO2018/049668
PCT Pub. Date: Mar. 22, 2018

(65) Prior Publication Data

US 2019/0291289 A1 Sep. 26, 2019

(51) Int. Cl.
*B26B 21/52* (2006.01)
*B26B 21/40* (2006.01)
*B26B 21/08* (2006.01)

(52) U.S. Cl.
CPC ..... *B26B 21/521* (2013.01); *B26B 21/40* (2013.01); *B26B 21/08* (2013.01)

(58) Field of Classification Search
CPC ..... B26B 21/521; B26B 21/08; B26B 21/40
See application file for complete search history.

(56) References Cited

U.S. PATENT DOCUMENTS

| | | | | |
|---|---|---|---|---|
| 4,573,266 | A * | 3/1986 | Jacobson | B26B 21/227 30/41 |
| 6,112,412 | A * | 9/2000 | Richard | B26B 21/443 30/41.5 |
| 6,311,400 | B1 * | 11/2001 | Hawes | B26B 21/225 30/50 |
| 6,557,265 | B2 * | 5/2003 | Coffin | B26B 21/225 30/50 |
| 7,200,942 | B2 * | 4/2007 | Richard | B26B 21/225 30/526 |
| 8,151,472 | B2 * | 4/2012 | Dimitris | B26B 21/225 30/527 |
| 10,427,312 | B2 * | 10/2019 | Gratsias | B26B 21/522 |
| 2019/0263010 | A1 * | 8/2019 | Griffin | B26B 21/4081 |
| 2019/0291289 | A1 * | 9/2019 | Ren | B26B 21/521 |
| 2019/0337174 | A1 * | 11/2019 | Kopelas | B26B 21/521 |

* cited by examiner

*Primary Examiner* — Hwei-Siu C Payer
(74) *Attorney, Agent, or Firm* — Shimokaji IP

(57) ABSTRACT

An elastic fastener for a shaver includes a left elastic arm, a right elastic arm, and a connecting arm. A left pivoting part is provided at a lower end of the left elastic arm, a left hook is provided; a right pivoting part is provided at a lower end of the right elastic arm, a right hook is provided. A left plane and a right plane are defined, the central pivoting line of the left pivoting part is located in the left plane, the central pivoting line of the right pivoting part is located in the right plane, and abutment areas of the left hook and the right hook abutted against the razor head during shaving are located in a space sandwiched between the two, so as to prevent a razor head from disengaging from a handle during shaving and ensure the reliability of shaving.

10 Claims, 3 Drawing Sheets

ELASTIC FASTENER FOR RAZOR

FIELD OF THE INVENTION

The present invention relates to technical field of shaving, and more particularly to an elastic fastener for a razor.

BACKGROUND OF THE INVENTION

With improvement of the economy and the society, abounding consumables are offered to people to satisfy people's demand, thereby improving people's standard or living. While razors are one of these consumables.

Currently, the razors have two types including electric razors and manual razors. The manual razors have a large share of the market due to its complete shaving effect and without power source.

Regarding to the manual razor, it includes a handle, a razor head, a buckle for connecting the razor head to the handle, and a button for actuating the buckle to disengage the razor head from the handle. Specifically, the buckle is assembled on the handle, the button is movably configured at the buckle to actuate the buckle, so that to make the buckle and the razor head engage or disengage.

However, during shaving of the conventional manual razor, an upper resistance force is generated to the buckle, so that the buckle is pushed and extruded towards the middle position, thereby disengaging from the razor head to decrease the reliability of shaving.

Thus, there is a need for an improved elastic fastener for a razor to overcome the above-mentioned drawbacks.

SUMMARY OF THE INVENTION

One objective of the present invention is to provide an elastic fastener for a razor which is capable of preventing a razor head from disengaging from a handle during shaving, thereby ensuring the reliability of shaving.

To achieve the above-mentioned objective, an elastic fastener for a razor adapted for connecting a razor head to a handle includes: a left elastic arm and a right elastic arm, which are arranged in a Y-axis direction and spaced in an X-axis direction; and a connecting arm for connecting the left elastic arm and the right elastic arm together to form one piece. A left pivoting part is provided at a lower end of the left elastic arm to connect with the handle, and a central pivoting line of the left pivoting part is arranged in a Z-axis direction, a left hook is extended at an upper end of the left elastic arm in the X-axis direction to engage with the razor head; a right pivoting part is provided at a lower end of the right elastic arm to pivotally connect with the handle, and a central pivoting line of the right pivoting part is arranged in the Z-axis direction, a right hook is extended at an upper end of the right elastic arm in the X-axis direction to engage with the razor head, a left plane and a right plane vertical to an X axis are defined, the central pivoting line of the left pivoting part is located in the left plane, the central pivoting line of the right pivoting part is located in the right plane, and abutment areas of the left hook and the right hook abutted against the razor head during shaving are located in a space sandwiched between the left plane and the right plane.

Preferably, the left hook and the right hook are tilted downwards relative to the X-axis direction.

Preferably, a tilted angle of the left hook and the right hook is in a range of 1-5°.

Preferably, the left elastic arm has a left part which intersects with the left hook and located in the space sandwiched between the left plane and the right plane, a plane where the left part is located and the left plane are intersected, with an intersected line is the central pivoting line of the left pivoting part, and an angle $\alpha$ is formed between the plane where the left part is located and the left plane, therein $0<\alpha\leqslant 4°$. More preferably, the angle $\alpha$ has a range of $0<\alpha\leqslant 0.5°$.

Preferably, the right elastic arm has a right part which intersects with the right hook and located in the space sandwiched between the left plane and the right plane, a plane where the right part is located and the right plane are intersected, with an intersected line is the central pivoting line of the right pivoting part, and an angle $\alpha$ is formed between the plane where the right part is located and the right plane, therein $0<\alpha\leqslant 4°$. More preferably, the angle $\alpha$ has a range of $0<\alpha\leqslant 3.5°$.

Preferably, the connecting arm is a V-shaped structure, a lower end of the left elastic arm, the connecting arm, and a lower end of the right elastic arm together form an M-shaped structure.

Preferably, the left elastic arm and the right elastic arm are symmetrical.

Preferably, at least one of the left hook and the right hook is a circular ring piece.

In comparison with the prior art, the central pivoting line of the left pivoting part is located in the left plane, the central pivoting line of the left pivoting part is located in the right plane, the left plane and the right plane are vertical to X axis, the abutment areas of the left hook and the right hook where are abutted against the razor head during shaving are located in a space sandwiched between the left plane and the right plane, specifically, the abutment areas of the left hook abutted against the razor head during shaving is located at a right side of the central pivoting line of the left pivoting part, the abutment areas of the right hook abutted against the razor head during shaving is located at a left side of the central pivoting line of the left pivoting part. Therefore, during shaving, the left resistance force is generated on the abutment area 13*a* of the left hook, accordingly, a left torque causing the left hook to expand is generated due to the left resistance force and the distance between the left resistance force and the pivoting center. Meanwhile, the right resistance force is generated on the abutment area of the right hook, accordingly, a right torque causing the left hook to expand is generated due to the right resistance force and the distance between the right resistance force and the pivoting center. Under the combined action of the left torque and right torque, both of the left hook and the right hook are expanded one another, thereby efficiently preventing the razor head disengaging from the left hook and the right hook, and finally improving the reliability of the razor.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings.

Figure 1:
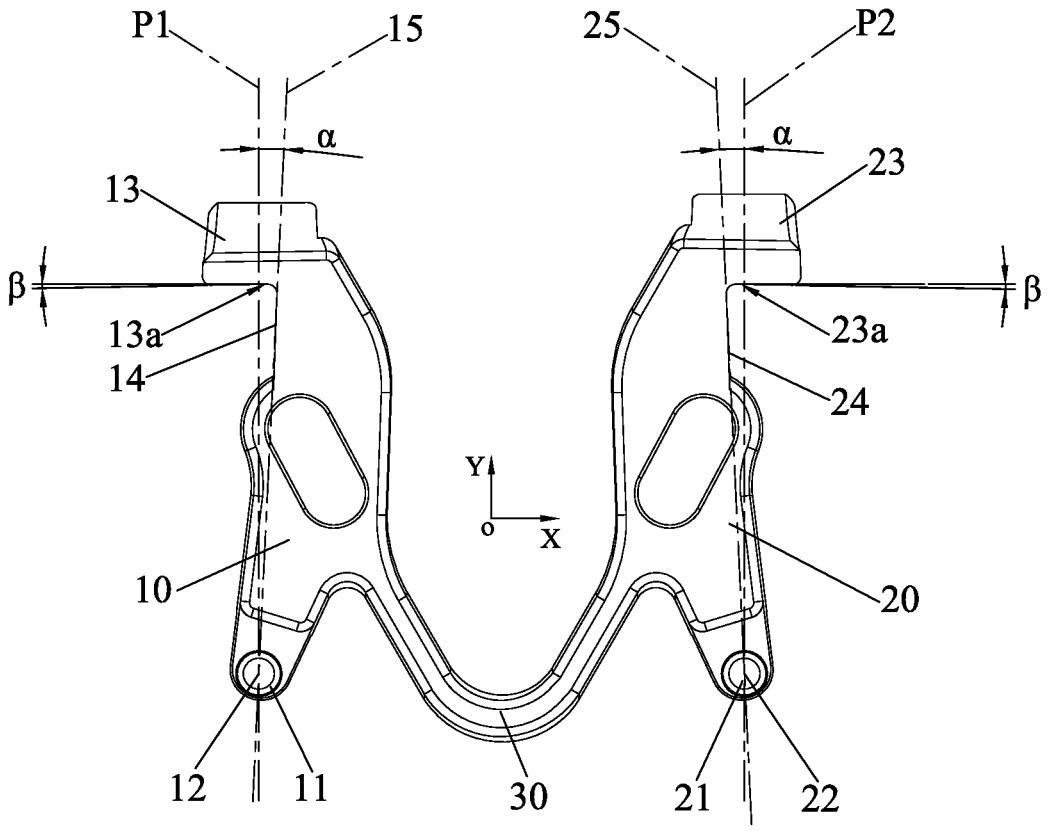
FIG. 1 is a front view of an elastic fastener for a razor according to an embodiment of the present invention.
Figure 2:
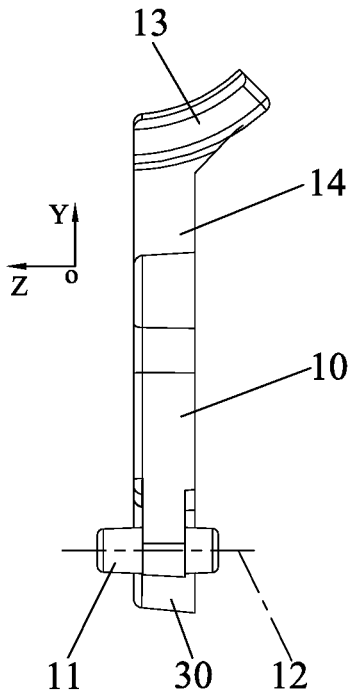
FIG. 2 is a left view of the elastic fastener for a razor of FIG. 1.
Figure 3:
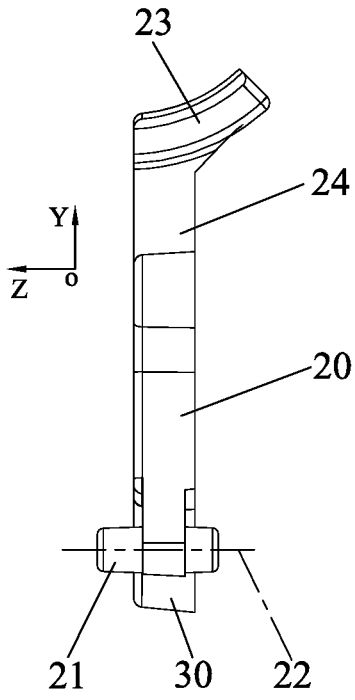
FIG. 3 is a right view of the elastic fastener for a razor of FIG. 1.
Figure 4:
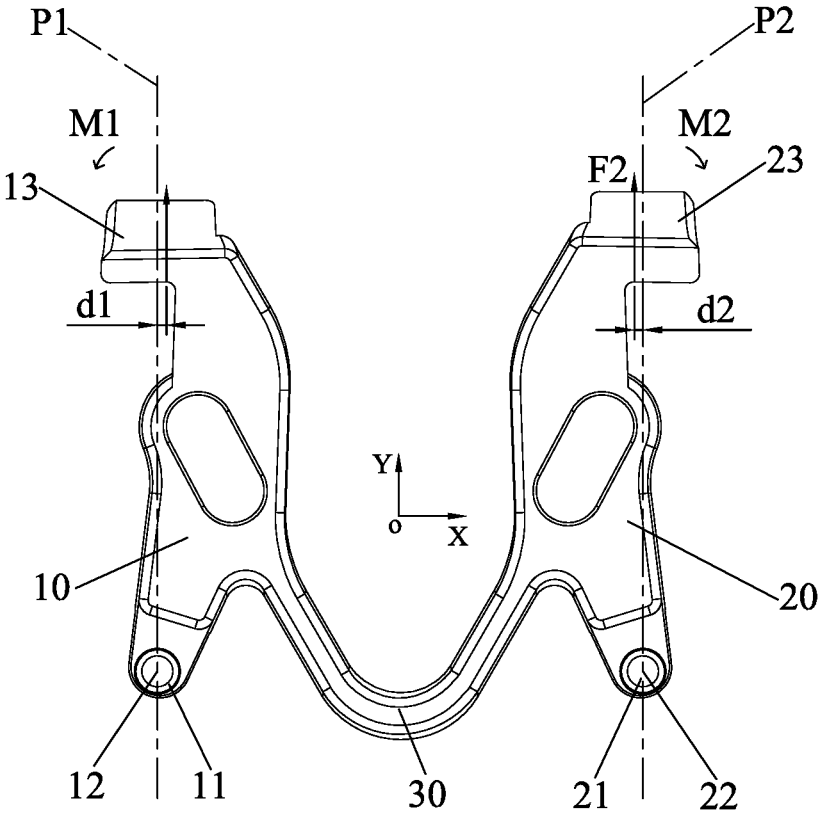
FIG. 4 is a front view of the elastic fastener for a razor showing the force analysis of the elastic fastener.

Referring to FIGS. 1-4, an elastic fastener for a razor 100 according to present invention is adapted for connecting a razor head to a handle (not shown), and the elastic fastener 100 includes a left elastic arm 10 and a right elastic arm 20 which are arranged in a Y-axis direction and spaced in an X-axis direction, and a connecting arm 30 connecting the left elastic arm 10 and the right elastic arm 20. Specifically, as shown in FIG. 1 and FIG. 4, in this embodiment, the left elastic arm 10 and the right elastic arm 20 are perfectly symmetrical, thus the structure is simplified. Further, the left elastic arm 10, the right elastic arm 20 and the connecting arm 30 are formed in one piece by injection molding, so as to ensure their elasticity.

As illustrated in FIGS. 1, 2 and 4, a left pivoting part 11 is provided at a lower end of the left elastic arm 10 to connect with the handle, and a central pivoting line 12 of the left pivoting part 11 is arranged in a Z-axis direction, as shown in FIG. 2. A left hook 13 is extended at an upper end of the left elastic arm 10 in the X-axis direction to engage with the razor head. Specifically, the left hook 13 is a curved piece, and the left hook 13 is tiled downwards relative to the X axis, so as to prevent the razor head sliding beyond the left hook 13 during shaving. Preferably, as shown in FIG. 1, the tilted angle β of the left hook 13 is in a range of 1-5°, in such a way, the razor head is prevented from sliding out of the left hook 13, further, the assembly and the disassembly between the razor head and the left hook 13 are convenient.

As illustrated in FIGS. 1, 3 and 4, a right pivoting part 21 is provided at a lower end of the right elastic arm 20 to pivotally connect with the handle, and a central pivoting line 22 of the right pivoting part 21 is arranged in the Z-axis direction, as shown in FIG. 3. A right hook 23 is extended at an upper end of the right elastic arm 20 in the X-axis direction to engage with the razor head. Specifically, the right hook 23 is a curved piece, and the right hook 23 is tiled downwards relative to the X axis, so as to prevent the razor head sliding beyond the right hook 23 during shaving. Preferably, as shown in FIG. 1, the tilted angle β of the right hook 23 is in a range of 1-5°, in such a way, the razor head is prevented from sliding out of the right hook 23, further, the assembly and the disassembly between the razor head and the right hook 23 is convenient.

As shown in FIG. 1, a left plane P1 and a right plane P2 are definite planes which are vertical to the X axis, and the central pivoting line 12 of the left pivoting part 11 is located in the left plane P1, and the central pivoting line 22 of the right pivoting part 21 is located in the right plane P2. Abutment areas 13*a* and 23*a* of the left hook 13 and the right hook 23 abutted against the razor head during shaving are located in a space sandwiched between the left plane P1 and the right plane P2. Specifically, in the present embodiment, the left elastic arm 10 has a left part 14 which is intersected with the left hook 13 and located in the space sandwiched between the left plane P1 and the right plane P2. The plane 15 where the left part 14 is located and the left plane P1 are intersected, with an intersected line is the central pivoting line 12 of the left pivoting part 11. Specifically, an angle α is formed between the plane where the left part 14 is located and the left plane P1, $0<\alpha\leqslant 4°$, preferably, $0<\alpha\leqslant 3.5°$. In such a configuration, the abutment area 13*a* of the left hook 13 can be located in the space sandwiched between the left plane P1 and the right plane P2.

Similarly, the right elastic arm 20 has a right part 24 which is intersected with the right hook 23 and located in the space sandwiched between the left plane P1 and the right plane P2. The plane 25 where the right part 24 is located and the right plane P2 are intersected, with an intersected line is the central pivoting line 22 of the right pivoting part 21. Specifically, an angle α is formed between the plane where the right part 24 is located and the right plane P2, $0<\alpha\leqslant 4°$, preferably, $0<\alpha\leqslant 3.5°$. In such a configuration, the abutment area 23*a* of the right hook 23 can be located in the space sandwiched between the left plane P1 and the right plane P2. In this embodiment, the connecting arm 30 is a V-shaped structure, a lower end of the left elastic arm 10, the connecting arm 30, and a lower end of the right elastic arm 20 together form an M-shaped structure. In such configurations, the cooperation of the left elastic arm 10 and the right elastic arm 20 is reliable, and the elasticity is forceful.

As shown in FIG. 4, during shaving, the razor head applies a left resistance force F1 to the abutment area 13*a* of the left hook 13, accordingly, a left torque M1 causing the left hook 12 to expand is generated due to the left resistance force F1 and the distance d1 between the left resistance force F1 and the pivoting center. Meanwhile, the razor head applies a right resistance force F2 to the abutment area 23*a* of the right hook 23, accordingly, a right torque M2 causing the left hook 12 to expand is generated due to the right resistance force F2 and the distance d2 between the right resistance force F2 and the pivoting center. Under the combined action of the left torque M1 and right torque M2, both of the left hook 13 and the right hook are expanded one another, thereby efficiently preventing the razor head disengaging from the left hook 13 and the right hook 23.

In comparison with the prior arts, the central pivoting line 12 of the left pivoting part 11 is located in the left plane P1, the central pivoting line 22 of the left pivoting part 21 is located in the right plane P2, the left plane P1 and the right plane P2 are vertical to X axis, the abutment areas 13*a* and 23*a* of the left hook 13 and the right hook 23 where are abutted against the razor head during shaving are located in a space sandwiched between the left plane P1 and the right plane P2, specifically, the abutment areas 13*a* of the left hook 13 abutted against the razor head during shaving is located at a right side of the central pivoting line 12 of the left pivoting part 11, the abutment areas 23*a* of the right hook 23 abutted against the razor head during shaving is located at a left side of the central pivoting line 22 of the left pivoting part 21. Therefore, during shaving, the left resistance force F1 is generated on the abutment area 13*a* of the left hook 13, accordingly, a left torque M1 causing the left hook 12 to expand is generated due to the left resistance force F1 and the distance d1 between the left resistance force F1 and the pivoting center. Meanwhile, the right resistance force F2 is generated on the abutment area 23*a* of the right hook 23, accordingly, a right torque M2 causing the left hook 12 to expand is generated due to the right resistance force F2 and the distance d2 between the right resistance force F2 and the pivoting center. Under the combined action of the left torque M1 and right torque M2, both of the left hook 13 and the right hook 23 are expanded one another, thereby efficiently preventing the razor head disengaging from the left hook 13 and the right hook 23, and finally improving the reliability of the razor.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. An elastic fastener for a razor, adapted for connecting a razor head of the razor to a handle of the razor, and the elastic fastener comprising:

a left elastic arm and a right elastic arm, which are arranged in a Y-axis direction and spaced in an X-axis direction; and a connecting arm for connecting the left elastic arm and the right elastic arm together to form one piece;

wherein a left pivoting part is provided at a lower end of the left elastic arm to connect with the handle, and a central pivoting line of the left pivoting part is arranged in a Z-axis direction, a left hook is extended at an upper end of the left elastic arm in the X-axis direction to engage with the razor head; a right pivoting part is provided at a lower end of the right elastic arm to pivotally connect with the handle, and a central pivoting line of the right pivoting part is arranged in the Z-axis direction, a right hook is extended at an upper end of the right elastic arm in the X-axis direction to engage with the razor head, a left plane and a right plane vertical to an X axis are defined, the central pivoting line of the left pivoting part is located in the left plane, the central pivoting line of the right pivoting part is located in the right plane, and abutment areas of the left hook and the right hook abutted against the razor head during shaving are located in a space sandwiched between the left plane and the right plane.

2. The elastic fastener for a razor according to claim 1, wherein the left hook and the right hook are tilted downwards relative to the X-axis direction.

3. The elastic fastener for a razor according to claim 2, wherein a tilted angle of the left hook and the right hook with respect to the X axis is in a range of 1-5°.

4. The elastic fastener for a razor according to claim 1, wherein the left elastic arm has a left part which intersects with the left hook and located in the space sandwiched between the left plane and the right plane, a plane where the left part is located and the left plane are intersected, with an intersected line is the central pivoting line of the left pivoting part, and an angle $\alpha$ is formed between the plane where the left part is located and the left plane, therein $0<\alpha\leq 4°$.

5. The elastic fastener for a razor according to claim 4, wherein the angle $\alpha$ has a range of $0<\alpha\leq 3.5°$.

6. The elastic fastener for a razor according to claim 1, wherein the right elastic arm has a right part which intersects with the right hook and located in the space sandwiched between the left plane and the right plane, a plane where the right part is located and the right plane are intersected, with an intersected line is the central pivoting line of the right pivoting part, and an angle $\alpha$ is formed between the plane where the right part is located and the right plane, therein $0<\alpha\leq 4°$.

7. The elastic fastener for a razor according to claim 6, wherein the angle $\alpha$ has a range of $0<\alpha\leq 3.5°$.

8. The elastic fastener for a razor according to claim 1, wherein the connecting arm is a V-shaped structure, the lower end of the left elastic arm, the connecting arm, and the lower end of the right elastic arm together form an M-shaped structure.

9. The elastic fastener for a razor according to claim 1, wherein the left elastic arm and the right elastic arm are symmetrical.

10. The elastic fastener for a razor according to claim 1, wherein at least one of the left hook and the right hook is a curved piece.

* * * * *